United States Patent [19]

Ootuka et al.

[11] Patent Number: 4,550,703

[45] Date of Patent: Nov. 5, 1985

[54] CONTINOUS METHOD OF FUEL INJECTION IN ELECTRONICALLY CONTROLLED ENGINE

[75] Inventors: Takayuki Ootuka; Toshiyuki Murai, both of Susono, Japan

[73] Assignee: Toyota Jidosha Kogyo Kabushiki Kaisha, Toyota, Japan

[21] Appl. No.: 357,148

[22] Filed: Mar. 11, 1982

[30] Foreign Application Priority Data

Sep. 28, 1981 [JP] Japan ..... 56-152045

[51] Int. Cl.[4] ..... F02M 51/00

[52] U.S. Cl. ..... 123/478; 123/493; 123/325

[58] Field of Search ..... 123/478, 492, 493, 325, 123/326, 339

[56] References Cited

U.S. PATENT DOCUMENTS

| | | | |
|---|---|---|---|
| 3,690,305 | 9/1972 | Shimada et al. | 123/326 |
| 4,221,191 | 9/1980 | Asano et al. | 123/493 X |
| 4,242,991 | 1/1981 | Scherenberg et al. | 123/325 |
| 4,250,853 | 2/1981 | Harada et al. | 123/493 X |
| 4,305,365 | 12/1981 | Iizuka et al. | 123/493 |
| 4,326,488 | 4/1982 | Herth et al. | 123/492 |
| 4,327,682 | 5/1982 | Harada | 123/326 |
| 4,334,513 | 6/1982 | Nakajima et al. | 123/492 |
| 4,353,342 | 10/1982 | Sugasawa et al. | 123/493 |
| 4,357,924 | 11/1982 | Sugasawa et al. | 123/493 |
| 4,383,514 | 5/1983 | Fiala | 123/493 X |

FOREIGN PATENT DOCUMENTS

| | | | |
|---|---|---|---|
| 2847794 | 5/1979 | Fed. Rep. of Germany | 123/493 |

*Primary Examiner*—Parshotam S. Lall
*Assistant Examiner*—W. R. Wolfe
*Attorney, Agent, or Firm*—Finnegan, Henderson, Farabow, Garrett & Dunner

[57] ABSTRACT

The minimum fuel injection time is on electronically controlled fuel injection engine is set in relation to the running condition of the engine. For example, in shift change, when the throttle valve is in the idling angle and the revolution speed of the engine is high, the minimum fuel injection time is set to a small value to improve the efficiency of fuel consumption. Also, at the completion of fuel cut-off when the revolution speed of the engine is low, the minimum fuel injection time is set to a large value to improve the driveability of the vehicle.

10 Claims, 8 Drawing Figures

CONTINOUS METHOD OF FUEL INJECTION IN ELECTRONICALLY CONTROLLED ENGINE

BACKGROUND OF THE INVENTION

1. Field of the Invention

This invention relates to a fuel injection method in an electronically controlled engine for calculating fuel injection amounts by the use of a microprocessor.

2. Description of the Prior Art

In abrupt deceleration or the like, a measuring plate of an air flow meter produces undershoot, and intake air flow detected from the output of the air flow meter is remarkably smaller than actual intake air flow so that the fuel injection amount calculated on the basis of the output of the air flow meter has a very small value, causing a misfire. Thus, to avoid such misfire, the minimum fuel injection amount is determined and, when the calculated fuel injection amount is smaller than the minimum fuel injection amount, the fuel injection amount is made to be the minimum fuel injection amount. In the prior fuel injection method, however, the minimum fuel injection amount was constant irrespectively of the running condition of an engine. Since the minimum fuel injection amount capable of avoiding misfire varies with the running condition of the engine, when the minimum fuel injection amount is determined so as not to adversely affect driveability of the vehicle in the prior fuel injection method, noxious components in exhaust gas increase and efficiency of fuel consumption is degraded under a predetermined running condition of the engine. On the other hand, when the minimum fuel injection amount is determined so as to restrain the noxious amount of components in the exhaust gas, the driveability is degraded under another predetermined running condition of the engine.

SUMMARY OF THE INVENTION

An object of the present invention is to provide a fuel injection method in an electronically controlled engine in which the minimum fuel injection amount is determined so as to satisfy driveability, fuel consumption and exhaust emission requirements of a vehicle.

To achieve this object, in the fuel injection method of an electronically controlled engine constructed according to the present invention, the minimum fuel injection amount is set to a first predetermined value and then set to a second predetermined value higher than the first one if the driveability of the vehicle is adversely affected when the minimum fuel injection amount has the first predetermined value.

Consequently, the minimum fuel injection amount is changed according to the running condition of the engine so as to maintain the driveability upon the resumption of fuel supply after the completion of fuel cut-off while restraining noxious components in the exhaust gas and improving the efficiency of fuel consumption.

Whether or not the minimum fuel injection amount being set to the first predetermined value adversely affects the driveability of the vehicle is detected from the revolution speed of the engine. For example, when the revolution speed of the engine is lower than a third predetermined value, the minimum fuel injection amount is set to the second predetermined value.

Also, whether or not the minimum fuel injection amount being set to the first predetermined value adversely affects the driveability of the vehicle is detected, for example, from the revolution speed of the engine and the opening angle of a throttle valve is an intake system. When the revolution speed of the engine is lower than the third predetermined value and the opening angle of the throttle valve in the intake system is at the idling angle, the minimum fuel injection amount is set to the second predetermined value.

DETAILED DESCRIPTION OF PREFERRED EMBODIMENTS

Embodiments of the present invention will be described with reference to the drawings.

Figure 1:
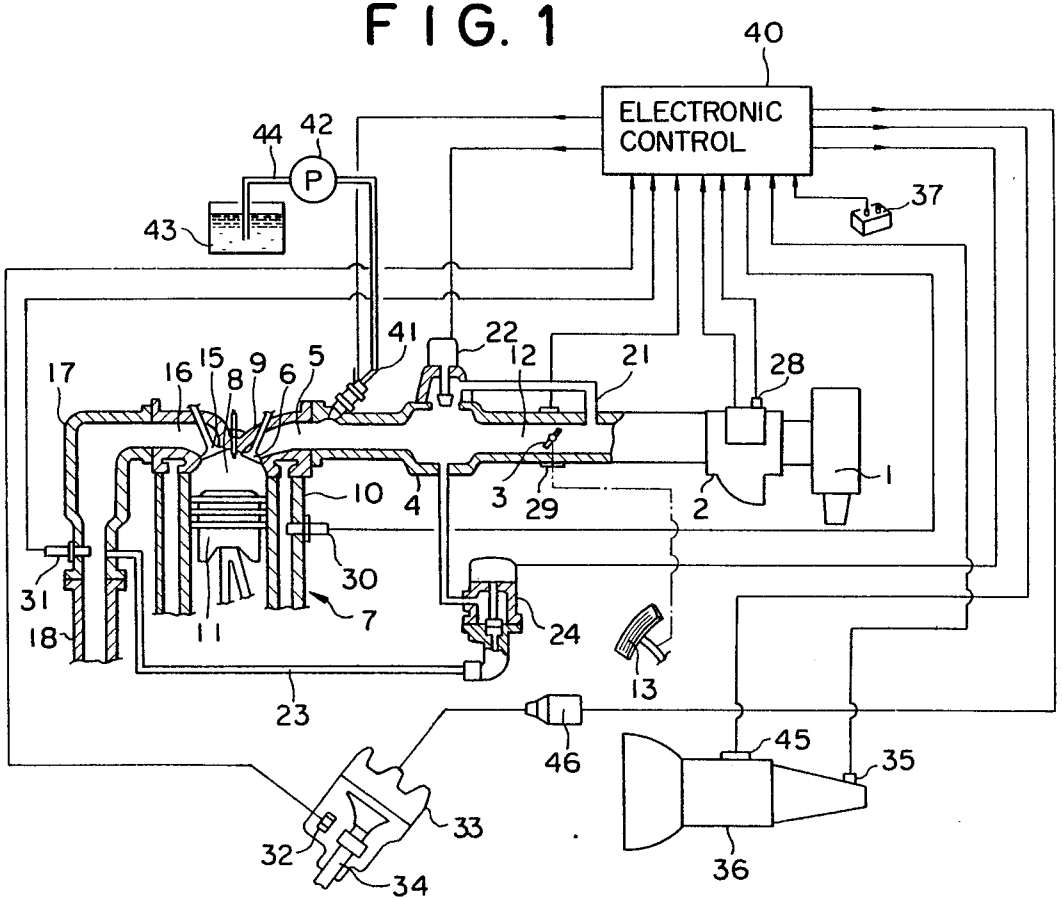
FIG. 1 is a schematic illustration of an electronically controlled engine constructed according to the present invention.

FIG. 1 is a schematic illustration of an electronically controlled engine constructed according to the present invention. Air sucked from an air cleaner 1 is sent to a combustion chamber 8 in an engine body 7 through an intake path 12 comprising an air flow meter 2, throttle valve 3, surge tank 4, intake port 5 and intake valve 6. The throttle valve 3 is interlocked with an accelerator pedal 13 in a cab. The combustion chamber 8 is defined by a cylinder head 9, cylinder block 10 and piston 11, and exhaust gas produced by combustion of the mixture is purged to the atmosphere through an exhaust valve 15, exhaust port 16, exhaust manifold 17 and exhaust pipe 18. A bypass path 21 connects the upstream side of the throttle valve 3 to the surge tank 4 and a bypass flow controlling valve 22 controls the sectional area of flow in the bypass path 21 to maintain the revolution speed of the engine constant at idle. An exhaust gas recirculation (EGR) path 23 for conducting a part of exhaust gas to the intake system to restrain the production of nitrogen oxide connects the exhaust manifold 17 to the surge tank 4, and an on-off type exhaust recirculation (EGR) controlling valve 24 opens and closes the EGR path 23 in response to electric pulses. An intake air temperature sensor 28 provided in the air flow meter 2 detects intake air temperature, and a throttle switch 29 detects the idling angle of the throttle valve 3. A water temperature sensor 30 mounted on the cylinder block 10 detects coolant temperature, i.e., engine temperature and an air fuel ratio sensor 31, well known to comprise an oxygen concentration sensor and mounted on the aggregate portion of the exhaust manifold 17, detects oxygen concentration in the aggregate portion. A crank angle sensor 32 detects the crank angle of a crank-shaft (not shown) in the engine body 7 from the rotation of a shaft 34 of a distributor 33 coupled with the crank-shaft, and a vehicle speed sensor 35 detects the revolution speed of the output shaft of an automatic transmission 36. The output of these sensors 2,28,29,30,31,32,35 and the voltage of an accumulator 37 are sent to an electronic control 40. A fuel injection valve 41 is provided respectively near each intake port 5 corresponding to each cylinder, and a pump 42 sends fuel to the fuel injection valve 41 through a fuel path 44 from a fuel tank 43. The electronic control 40 calculates the fuel injection amount by using the inputs from the respective sensors as parameters and sends electric pulses having a pulse width corresponding to the calculated fuel injection amount to the fuel injection valve 41. Also, the electronic control 40 controls the bypass flow controlling valve 22, EGR controlling valve 24, and a solenoid 45 in a hydraulic control circuit of automatic transmission 36 and an ignition system 46. The secondary side of ignition coil in the ignition system 46 is connected to the distributor 33.

Figure 2:
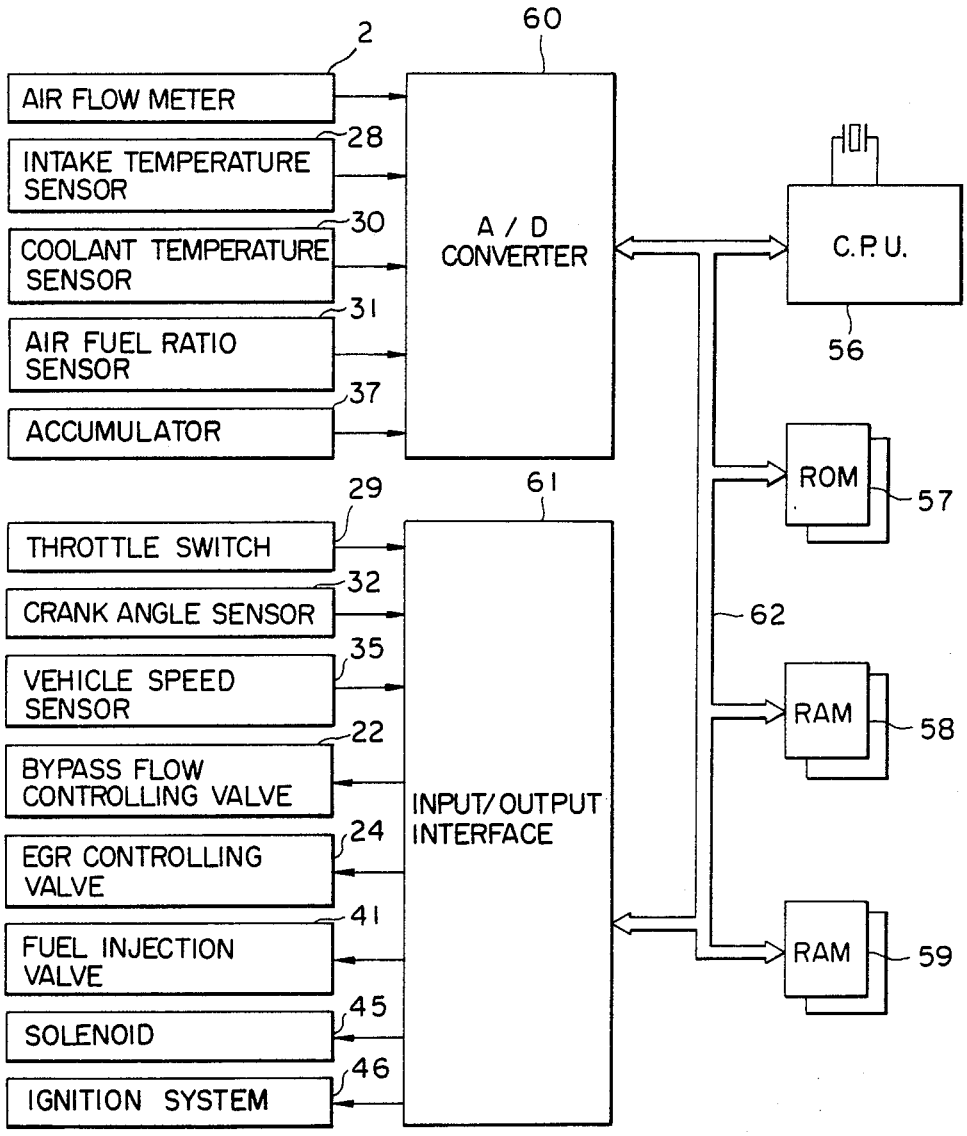
FIG. 2 is a block diagram of the electronic control of the engine shown in FIG. 1.

FIG. 2 is a block diagram of the interior of the electronic control. A CPU (Central Processing Unit) 56, a ROM (Read-Only Memory) 57, RAMs (Random Access Memory) 58,59, and an A/D (Analog/Digital) converter 60 with a multiplexer and input/output interface 61 are connected to each other through a bus 62. RAM 59 is connected to an auxiliary power source so that it can be hold its memory with a predetermined power supplied even in a period when the engine is stopped by opening the ignition switch. Analog signals from the air flow meter 2, intake air temperature sensor 28, water temperature sensor 30 and air fuel ratio sensor 31 are sent to A/D converter 60. The outputs of the throttle switch 29, crank angle sensor 32 and vehicle speed sensor 35 are sent to the input/output interface 61, and the bypass flow controlling valve 22, EGR controlling valve 24, solenoid 45 and ignition system 46 receive the input signals from the input/output interface 61.

Figure 3:
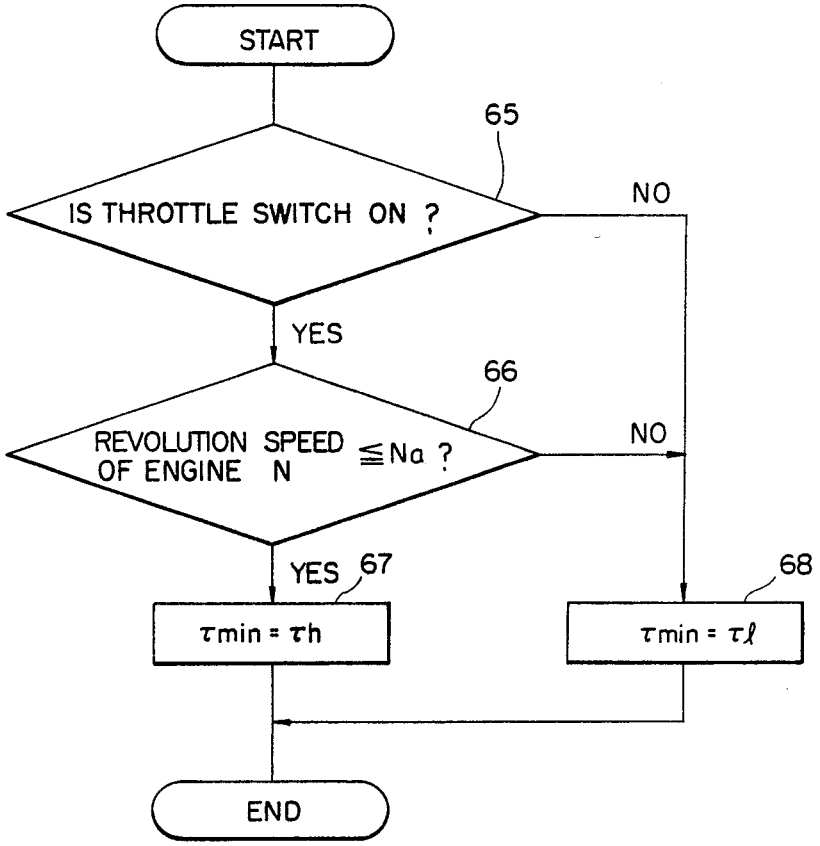
FIG. 3 is a flow chart of an example of a program for executing this method.

FIG. 3 is a flow chart of an example of a program for executing this method. Further in an embodiment of the electronically controlled engine, fuel is injected from the respective fuel injection valves once per cycle of the engine. The fuel injection amount is in proportion to the fuel injection time. In step 65, whether the throttle switch 29 is turned on or off is determined, and the program proceeds to step 66 if it is determined to be turned on and to step 68 if it is determined to be turned off. When the throttle valve 3 is in the idling angle, the throttle switch 29 is turned on, and when the throttle valve 3 is opened larger than the idling angle and throttle switch 29 is turned off. In step 66, it is determined whether or not the revolution speed N of the engine is lower than a predetermined value Na and the program proceeds to step 67 if it is determined to be yes and to step 68 if no. In step 67, i.e., when the throttle valve 3 is in the idling angle and the revolution speed N of the engine is lower than the predetermined valve Na, the minimum fuel injection time $\tau$min is set to be $\tau$h. The fuel injection time $\tau$h is the fuel injection time like the one upon the resumption of fuel supply after the completion of fuel cut-off, in which the minimum fuel injection amount to avoid miss fire corresponds to the minimum fuel injection amount under the running condition of the engine. In step 68, i.e., when the throttle valve 3 has the opening angle larger than the idling angle or the revolution speed N of the engine is higher than the predetermined value Na, the minimum fuel injection time $\tau$min is set to be $\tau$l ($\tau l < \tau h$). The fuel injecton time $\tau$l is the fuel injection time corresponding to the minimum fuel injection time under such running condition of the engine that the minimum fuel to avoid miss fire is reduced.

Figure 4:
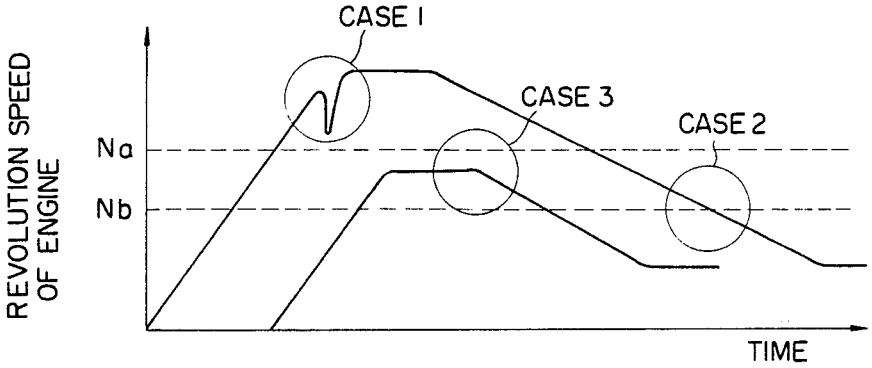
FIG. 4 is a drawing showing various travelling patterns of an automobile.

FIG. 4 shows various travelling patterns. Na is the minimum revolution speed of the engine to start fuel cut-off and equal to Na in step 66 of FIG. 3. When the revolution speed of the engine is lower than Na, fuel is not cut off even if the engine is under the decelerating condition. Also, Nb is the revolution speed of the engine under which the fuel cut-off is completed. Case 1 is one in which shift change is carried out while the revolution speed of the engine is higher than Na. Case 2 is one in which the fuel cut-off is completed and case 3 is one in which the engine is brought to the decelerating condition while the revolution speed of the engine is lower than Na.

Figure 5:
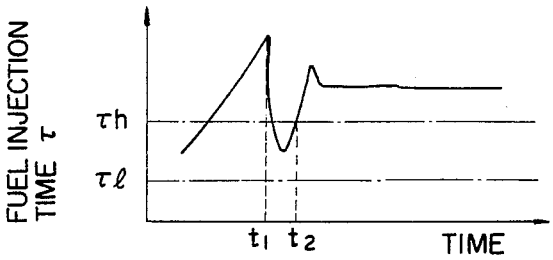
FIGS. 5,6 and 7 are drawings showing changes in fuel injection time according to the cases 1,2 and 3 shown in FIG. 4 respectively.

FIG. 5 shows change in the fuel injection time in case 1. At time t1, the throttle valve 3 has the idling angle and at time t2 it is again opened larger than the idling angle. The fuel is not immediately cut off after the throttle valve 3 has the idling angle, but cut off after a predetermined time elapses. In case 1, since the period of time from time t1 to t2 is short, fuel is not cut off, and since the revolution speed of the engine is higher than Na, the minimum fuel injection time is set to $\tau$l. Thus, a fuel injection time shorter than $\tau$l is allowed so that noxious components in exhaust gas are reduced and the efficiency of fuel consumption is improved.

Figure 6:
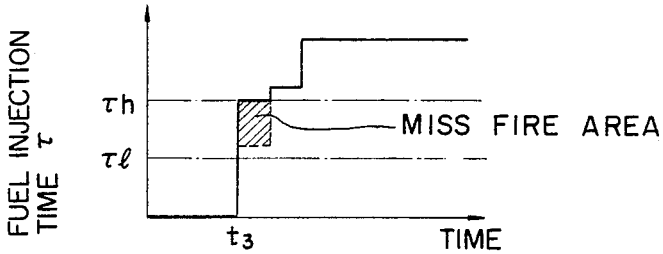

FIG. 6 shows change in the fuel injection time in case 2. At time t3, the revolution speed of the engine is lower than Nb and the fuel injection is resumed after the fuel cut-off is completed. In case 2, since the revolution speed of the engine is lower than Na the minimum fuel injection time $\tau$min is set to $\tau$h without causing any misfire to ensure a predetermined engine output, i.e., driveability of the vehicle. The broken line shows the fuel injection time in the prior method setting the minimum fuel injection time always to $\tau$l irrespective of the running condition of the engine. According to the prior method, noxious component amount in exhaust gas is to be restrained to provide a satisfactory result in case 1, but in case 2 a misfire may be caused thus adversely affecting the driveability of the vehicle.

Figure 7:
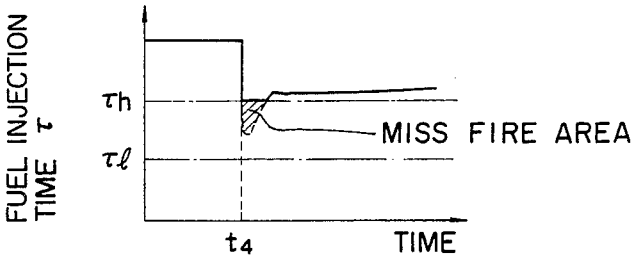

FIG. 7 shows change in the fuel injection time of case 3. The engine is under the decelerating condition in time t4. In case 3, since the revolution speed of the engine is lower than Na, the minimum fuel injection time $\tau$min is set to $\tau$h. Thus, a misfire is not caused, but a predetermined engine output (i.e., the driveability of the vehicle) is ensured.

Figure 8:
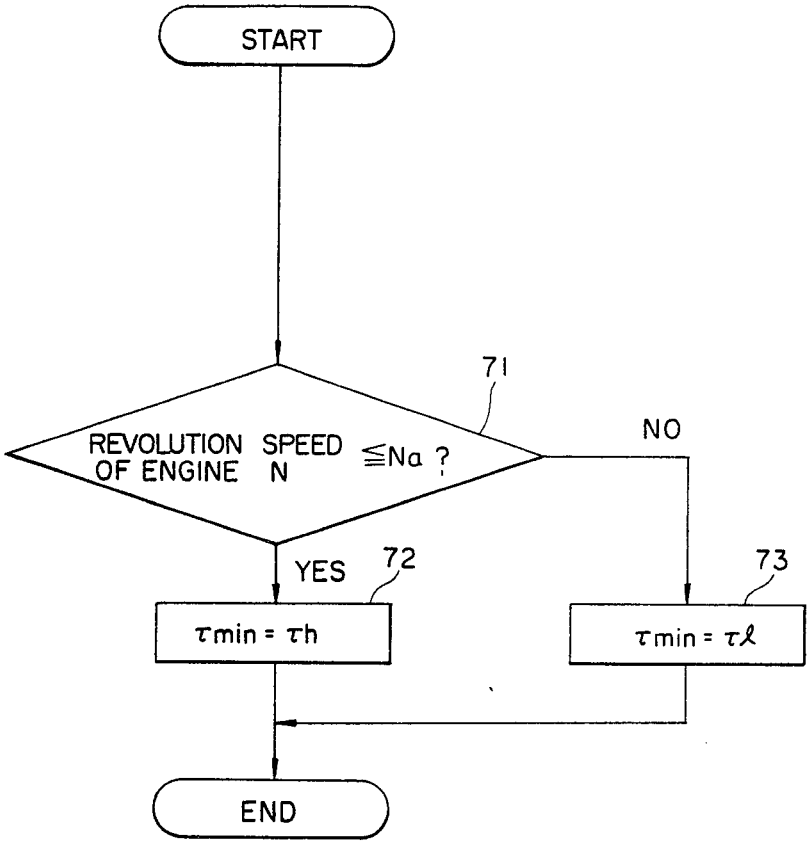
FIG. 8 is a flow chart of an example of another program for executing this method.

FIG. 8 is a flow chart of an example of another program for excuting this method. In step 71, it is determined whether or not the revolution speed N of the engine is lower than the predetermined value Na, and the program proceeds to step 72 if it is determined to be yes and to step 73 if no. In step 72, i.e., when the revolution speed N of the engine is lower than Na, the minimum fuel injection time $\tau$min is set to $\tau$h. In step 73, i.e., when the revolution speed N of the engine is higher than the predetermined value Na, the minimum fuel injection time $\tau$min is set to $\tau$l. Thus, under the running condition of the engine in which the minimum fuel injection time to avoid misfire increases, the minimum fuel injection time $\tau$min is set to large value $\tau$h and hindrances to the driveability are avoided. Under the running condition of engine in which the minimum fuel injection to avoid misfire decreases, the minimum fuel injection time $\tau$min is set to small value $\tau$l and thereby the noxious components in the exhaust gas can be restrained. In the embodiment shown in FIG. 8, a step corresponding to the step 65 in FIG. 3 is omitted to simplify the program.

What is claimed is:

1. A method for fuel injection in a vehicle with an electronically controlled engine having a calculated fuel injection amount and a minimum fuel injection amount, the minimum fuel injection amount, in the absence of fuel cut-off, being supplied to the engine when the calculated fuel injection amount is less than the minimum fuel injection amount, said method comprising the steps of:

setting the minimum fuel injection amount to a first predetermined value; and setting the minimum fuel injection amount to a second predetermined value higher than said first predetermined value whenever driveability of the vehicle is adversely affected by the setting of the minimum fuel injection amount to said first predetermined value.

2. A method as recited in claim 1 wherein an adverse effect on the driveability of the vehicle is detected from the revolution speed of the engine.

3. A method as recited in claim 2, wherein the minimum fuel injection amount is set to said first predetermined value when the revolution speed of the engine is higher than a third predetermined value, and the minimum fuel injection amount is set to said second predetermined value when the revolution speed of the engine is lower than said third predetermined value.

4. A method as recited in claim 1 wherein an adverse effect on driveability of the vehicle is detected from the revolution speed of the engine and the opening angle of a throttle valve in the intake system of the engine.

5. A method as recited in claim 4 wherein the minimum fuel injection amount is set to said first predetermined value when the revolution speed of the engine is higher than a third predetermined value or when the throttle value is not at the idling angle; and wherein the minimum fuel injection amount is set to said second predetermined value when the revolution speed of the engine is lower than the third predetermined value and the throttle valve is at the idling angle.

6. A method for fuel injection in a vehicle with an electronically controlled engine having a calculated fuel injection pulse width and a minimum fuel injection pulse width, the minimum fuel injection pulse width, in the absence of fuel cut-off, being supplied to the engine when the calculated fuel injection pulse width is less than the minimum fuel injection pulse width, said method comprising the steps of:

setting the minimum fuel injection pulse width to a first predetermined value; and setting the minimum fuel injection pulse width to a second predetermined value higher than said first predetermined value whenever driveability of the vehicle is adversely affected by the setting of the minimum fuel injection pulse width to said first predetermined value.

7. A method as recited in claim 6 wherein an adverse effect on the driveability of the vehicle is detected from the revolution speed of the engine.

8. A method as recited in claim 7 wherein the minimum fuel injection pulse width is set to said first predetermined value when the revolution speed of the engine is higher than a third predetermined value, and the minimum fuel injection pulse width is set to said second predetermined value when the revolution speed of the engine is lower than said third predetermined value.

9. A method as recited in claim 6 wherein an adverse effect on driveability of the vehicle is detected from the revolution speed of the engine and the opening angle of a throttle valve in the intake system of the engine.

10. A method as recited in claim 9 wherein the minimum fuel injection pulse width is set to said first predetermined value when the revolution speed of the engine is higher than a third predetermined value or when the throttle valve is not at the idling angle; and wherein the minimum fuel injection pulse width is set to said second predetermined value when the revolution speed of the engine is lower than said third predetermined value and the throttle valve is at the idling angle.

* * * * *